United States Patent [19]

Hashimoto et al.

[11] 4,339,270

[45] Jul. 13, 1982

[54] CORROSION RESISTANT AMORPHOUS NOBLE METAL-BASE ALLOYS

[75] Inventors: Koji Hashimoto, 25-5, Syogen 2-chome, Izumi-shi, Miyagi-ken; Tsuyoshi Masumoto, Sendai; Motoi Hara, Sendai; Katsuhiko Asami, Sendai; Kazutaka Sakiyama, Hohfu, all of Japan

[73] Assignees: Toyo Soda Manufacturing Co. Ltd., Shin-nanyo; Koji Hashimoto, Iaumi, both of Japan

[21] Appl. No.: 139,650

[22] Filed: Apr. 14, 1980

[30] Foreign Application Priority Data

May 16, 1979 [JP] Japan ..... 54-59171

[51] Int. Cl.[3] ..... C22C 30/00

[52] U.S. Cl. ..... 148/403; 204/293; 420/466; 420/462; 420/463; 420/461

[58] Field of Search ..... 75/172 R, 172 E, 122, 75/134 N, 134 S, 134 P; 204/293

[56] References Cited

U.S. PATENT DOCUMENTS 3,856,513 12/1974 Chen et al. ..... 75/122

*Primary Examiner*—R. Dean

*Attorney, Agent, or Firm*—Oblon, Fisher, Spivak, McClelland & Maier

[57] ABSTRACT

An amorphous alloy is prepared by rapid quenching from the liquid state and consists of (1) 10 to 40 atomic percent of P and/or Si (2) 90 to 60 atomic percent of two or more of Pd, Rh and Pt.

The amorphous alloy is used for an electrode for an electrolysis.

8 Claims, 1 Drawing Figure

CORROSION RESISTANT AMORPHOUS NOBLE METAL-BASE ALLOYS

BACKGROUND OF THE INVENTION

1. Field of the Invention

The present invention relates to amorphous alloys which possess excellent characteristics for electrode materials in electrolysis of aqueous solutions of alkali halides.

2. Description of the Prior Arts

It has been known to use electrodes made of corrosion resistant metals such as titanium coated with noble metals. However, when such electrodes are used as an anode in the electrolysis of aqueous solutions of sodium chloride, coated noble metals are severely corroded and sometimes peeled off from the titanium substrate. It is, therefore, difficult to use these electrodes for industrial processes.

On the other hand, modern chlor-alkali industries are using composite oxide electrodes consisting of corrosion resistant metals as a substrate on which composite oxides such as ruthenium oxide and titanium oxide are coated. When these electrodes are used as an anode in the electrolysis of sodium chloride solutions, they possess the following disadvantages; the composite oxides are sometimes peeled off from the metal substrate and chlorine gas produced are contaminated by a relatively large amount of oxygen. In addition, the corrosion resistance of the electrodes is not sufficiently high, particularly at low pH.

In general, ordinary alloys are crystalline in the solid state. However, rapid quenching of some alloys with specific compositions from the liquid state gives rise to solidification in the amorphous structure. These alloys are called amorphous alloys.

The amorphous alloys have significantly high mechanical strength in comparison with the conventional industrial alloys. Some amorphous alloys with specific compositions have extremely high corrosion resistance which cannot be obtained in ordinary crystalline alloys.

SUMMARY OF THE INVENTION

It is an object of the present invention to provide amorphous noble metal alloys which have extremely high corrosion resistance as well as high mechanical strength.

It is another object of the present invention to provide amorphous noble metal alloys which can be used as corrosion resistant electrodes for electrolysis without any trouble of peeling.

It is the other object of the present invention to provide corrosion resistant and energy saving amorphous noble metal electrode materials with a long life, by which electrolysis of aqueous alkali halide solutions at lower potentials actively generate halogen gases with a low oxygen contaminant.

The foregoing and other objects of the present invention have been attained by preparation of amorphous alloys by rapid quenching from the liquid state. The alloys consist of (1) 10–40 atomic percent P and/or Si and (2) 90–60 atomic percent of two or more Pd, Rh and Pt or (2') 90–60 atomic percent of two or more of Pd, Rh and Pt and 25 atomic percent or less Ti, Zr, Nb and/or Ta; (2'') 90–60 atomic percent Pd, Rh and/or Pt and 80 atomic percent or less Ir and/or Ru; (2''') 90–60 atomic percent Pd, Rh and/or Pt, 80 atomic percent or less Ir and/or Ru and 25 atomic percent or less Ti, Zr, Nb and/or Ta.

DETAILED DESCRIPTION OF THE PREFERRED EMBODIMENTS

Figure 1:
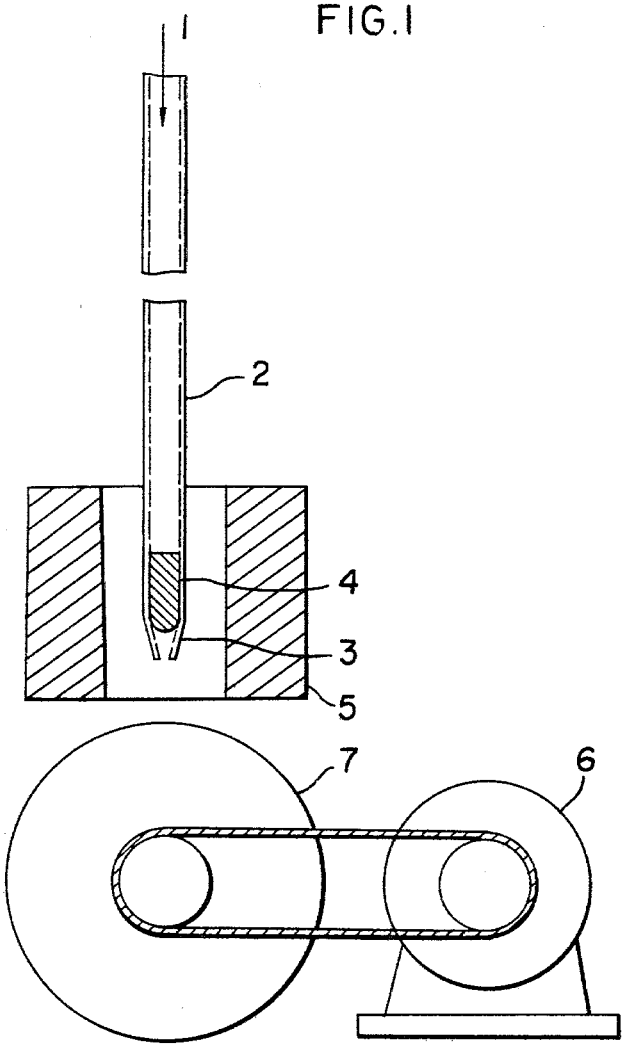
FIG. 1 is a schematic view of one embodiment of an apparatus for preparing amorphous alloys of the present invention.

The amorphous alloys prepared by rapid quenching of molten alloys with compositions mentioned above are single phase alloys in which the elements are uniformly distributed. On the contrary, ordinary crystalline alloys have many lattice defects which act as active surface sites with respect to corrosion. Therefore, crystalline metals, alloys or even noble metals cannot possess high corrosion resistance in very aggressive environments such as the environment to which an anode is exposed during electrolysis of sodium chloride solutions.

Electrodes which have been used for this purpose are composite oxide electrodes, that is, oxide mixture of noble metals and corrosion resistant metals such as ruthenium oxide-titanium oxide coated on corrosion resistant metals such as titanium in a thickness of several $\mu$m.

On the other hand, amorphous alloys are characterized by the high reactivity unless a stable surface film is formed. The high reactivity provides the rapid formation of protective surface film. In addition, the chemically homogeneous single phase nature of amorphous alloys provides the formation of uniform surface film without weak points with respect to corrosion. Accordingly, when the amorphous alloys of the present invention are used as electrodes, the alloys are immediately covered by a uniform protective passive film of 1–5 nm thickness and show extremely high corrosion resistance.

The passive film consists mainly of hydrated noble metal oxyhydroxide whereby the alloys possess excellent catalytic activity for electrochemical reactions such as evolution of halogen gases. Consequently, the amorphous alloys of the present invention have extremely high corrosion resistance and excellent characteristics for gas evolution as energy saving electrodes with a long life.

The preparation method of amorphous alloys of the present invention is as follows:

The amorphous alloys with compositions mentioned above can be prepared by rapid quenching from the liquid state at cooling rate of higher than 10,000° C./sec. If the cooling rate is slower than 10,000° C./sec., it is difficult to form a completely amorphous alloys. As a principle, the amorphous alloys of the present invention can be produced by any apparatus as far as the cooling rate higher than 10,000° C. is attained.

One embodiment of an apparatus for preparing the amorphous alloys of the present invention is shown in FIG. 1. In FIG. 1, a quartz tube (2) has a nozzle (3) at the lower end in the vertical direction, and raw materials (4) and an inert gas for preventing an oxidation of the raw materials are fed from the inlet (1). A heater (5) is placed around the quartz tube (2) so as to heat the raw materials (4). A high speed wheel (7) is placed below the nozzle (3) and is rotated by a motor (6).

The raw materials (4) having the specific composition are melted by the heater (5) in the quartz tube under inert gas atmosphere. The molten alloy is impinged by pressure of the inert gas onto the outer surface of the wheel (7) which is rotated at high speed of 1,000 to 10,000 rpm whereby the amorphous alloys of the present invention are formed as a long thin plate such as the plate having a thickness of 0.1 mm, a width of 10 mm and a length of several meters.

The amorphous alloys of the present invention produced by the above-mentioned procedure usually have a Vickers hardness of about 400 to 600 and a tensile strength of about 120 to 200 kg/mm$^2$ and have excellent mechanical characteristics as the amorphous alloys such as abilities for complete bending and coil rolling at greater than 50%.

The detail of the amorphous alloys of the present invention will be illustrated.

Energy saving electrodes with a long life should have characteristics of high catalytic activity in electrolytic reactions such as high activity for gas evolution reaction along with high corrosion resistance and high mechanical strength under the electrolytic conditions.

As described above, it is important to have the amorphous structure for the alloys in order to possess extremely high corrosion resistance and excellent mechanical characteristics.

The alloys with the specific compositions defined above can form the amorphous structure and satisfy the purpose of the present invention, that is, excellent electrochemical catalytic activities and extremely high corrosion resistance.

The typical compositions are shown in Table 1.

The amorphous alloys of the present invention have excellent characteristics in comparison with composite oxides such as ruthenium oxide-titanium oxide on a corrosion resistant metal as described in Japanese Patent Publication No. 20440/1977.

For example, when the alloys are used as electrodes for electrolysis of aqueous sodium chloride solutions, the corrosion rates of the amorphous alloys of the present invention are several orders of magnitude lower than those of the conventional composite oxide electrodes. The overvoltage for chlorine evolution of the amorphous alloys of the present inverntion is substantially the same or lower than those of the conventional composite oxide electrodes. Furthermore, the oxygen content of chlorine gas produced on the amorphous alloys of the present invention is one-fifth or less in comparison with that of chlorine gas produced on the conventional composite oxide electrodes.

The amorphous alloys of the present invention also possess high corrosion resistance and high activity for gas evolution in aqueous solutions of the other metal halides such as KCl. Therefore, the amorphous alloys of the present invention have excellent characteristics for energy saving electrode materials with a long life for electrolysis. In particular, the amorphous alloys of the present invention are advantageously used for anodes for production of sodium hyroxide, potassium hydroxide, chlorine gas, bromine gas or chlorate, in a diaphragm or ion exchange membrane process.

The reason of the definitions of the components in the amorphous alloys of the present invention will be illustrated as follows:

Addition of P and/or Si is necessary for forming the amorphous structure and also effective for rapid formation of protective passive film. However, when the total content of P and Si is less than 10 atomic percent or higher than 40 atomic percent, it is difficult to form the amorphous structure. Therefore, the total content of P and Si must be in a range of 10 to 40 atomic percent. In particular, the amorphous structure can be easily obtained when the total content of P and Si is in a range of 16 to 30 atomic percent.

It has been known that addition of B or C is also effective in forming the amorphous structure for iron-, cobalt- or nickel-base alloys. The amorphous noble metal alloys of the present invention, however, become brittle to some extent by the addition of B or C, and hence all of P and/or Si cannot be substituted by B and/or C but substitution of P and/or Si in 7 atomic percent or less by B and/or C is possible since the ductility of the alloys is maintained.

The elements Pd, Rh and/or Pt are main metallic components of the amorphous alloys of the present invention and are effective in forming the amorphous structure and evolving halogen gases. The element Pd or Rh is especially effective in evolving the gases whereas the element Rh or Pt is effective in improving the corrosion resistance of the electrodes. Thus, unless Ir and/or Ru are added, the alloys must contain at least two of Pd, Rh and Pt. When one of Pd, Rh or Pt is the main metallic component of alloys which do not contain Ir and/or Ru, it is preferable that the alloys contain 10 atomic percent or more of the other one or two of Pd, Rh and Pt in order to provide high activity for gas evolution and high corrosion resistance.

The elements Ir and Ru are both effective in increasing the activity for gas evolution and the corrosion resistance. Accordingly, when Ir and/or Ru are added to the alloys, it is not necessary that the alloys contain two or more of Pd, Rh and Pt. It is, however, preferable for the high activity for gas evolution and high corrosion resistance that, when the amorphous alloys contain only one of Pd, Rh or Pt and do not contain Ti, Zr, Nb and/or Ta, the total content of Ir and Ru is more than 20 atomic percent.

On the other hand, Ir or Ru alloys containing P and/or Si hardly form the amorphous structure by rapid quenching from the liquid state, unless Pd, Rh and/or Pt are added to the alloys. It is, therefore, necessary for the formation of amorphous structure that the total content of Ir and Ru is 80 atomic percent or less and the total content of Pd, Rh and Pt is 10 atomic percent or more.

The elements Ti, Zr, Nb and Ta are significantly effective in increasing the corrosion resistance and facilitating the formation of the amorphous structure. However, the addition of Ti, Zr, Nb and Ta in a large amount lowers the activity for gas evolution. Therefore, when Ti, Zr, Nb and/or Ta are added, the total content of these elements in the amorphous alloys muut be 25 atomic percent or less.

In addition, when the amorphous alloys contain only Pd or Rh among Pd, Rh and Pt and do not contain Ir and/or Ru, it is preferable for the high corrosion resistance that the total content of one or more of Ti, Zr, Nb and Ta is 1 atomic percent or more. On the other hand, when alloys contain only Pt among Pd, Rh and Pt, it is preferable for the high activity for gas evolution that the total content of Ir and Ru is 2 atomic percent or more.

As described above, the alloys of the present invention are the amorphous alloys having the specific compositions consisting of elements selected from the elements for improving the activity for gas evolution such as Pd, Rh, Ir or Ru and the elements for improving the corrosion resistance such as Rh, Pt, Ir, Ru, Ti, Zr, Nb or Ta.

Consequently, these alloys possess both the high activity for gas evolution and high corrosion resistance and hence can be used as energy saving electrode materials with a long life for electrolysis of aqueous solutions of alkali halides.

The purpose of the present investigation can be also attained by addition of a small amount (about 2 atomic percent) of other elements such as V, Cr, Mo, W, Fe, Co, Ni, Cu, Ag, and Au.

The amorphous alloys of the present invention will be further illustrated by certain examples which are provided only for purpose of illustration and are not intended to be limiting the present invention.

EXAMPLE 1

Amorphous alloys whose compositions are shown in Table 1 were prepared by rapid quenching from the liquid state by using the apparatus shown in FIG. 1. The amorphous alloy sheets prepared were 0.02–0.05 mm thick, 1–3 mm wide and 10 m long. Specimens cut from the amorphous alloy sheets were used as anodes in electrolysis of stagnant aqueous 4 M NaCl solution at 80° C. and pH 4.

Corrosion rates of amorphous alloys were obtained from the weight loss of specimens after electrolysis for 10 days at a constant current density of 50 A/dm$^2$. The solution was renewed every 12 hours during electrolysis.

Table 2 shows corrosion rates and potentials of specimens measured during chlorine evolution at a current density of 50 A/dm$^2$. Potentials shown in Table 1 are relative to the saturated calomel electrode.

The corrosion resistance of almost all the amorphous alloys of the present invention is several orders of magnitude higher than those of the composite oxide electrodes used in modern chlor-alkali industries. In particular, all the amorphous alloys which show the corrosion rate lower than 1 μm/year in Table 2 passivate spontaneously in the hot concentrated sodium chloride solution and can be used as anodes for several tens of years for electrolysis of the sodium chloride solutions.

On the other hand, the oxide electrode consisting of ruthenium oxide on titanium has higher activity for chlorine gas evolution than the composite oxide electrodes which are used in modern chlor-alkali industries, although ruthenium oxide on titanium has lower corrosion resistance than that of the composite oxide electrodes. The overvoltage of the ruthenium oxide electrode on titanium for chlorine evolution measured galvanostatically at 50 A/dm$^2$ was about 1.095 V (SCE), and the current used for the evolution of oxygen which is contaminant of chlorine gas is 18% of total current passed on the ruthenium oxide electrode on titanium under the present experimental conditions.

In contrast, the current used for oxygen evolution on the amorphous alloys of the present invention is less than 0.4% of the total current passed under the present experimental conditions.

Furthermore, when the amount of chlorine gas produced potentiostatically at 1.10 V(SCE) on the amorphous alloys of the present invention is compared with the amount of chlorine gas produced on the ruthenium oxide electrode on titanium under the same conditions, the amount of chlorine is 1.5 times on the specimen No. 61, 1.3 times on the specimens No. 46, 60, 62, 66, 67 and 71, and 1.2 times on the specimens No. 26, 36, 40, 48, 50, 53 and 62. The oxygen content of chlorine gas produced on these amorphous alloys is less than 0.05%.

Consequently, the amorphous alloys of the present invention can be used as energy saving electrodes with a long life for electrolysis of alkali halide solutions to produce high purity halogen gases.

EXAMPLE 2

Electrolysis was carried out by using the amorphous alloys as anodes in 4 M NaCl solution at pH 2 and 80° C. (this is further severe corrosive environment comparing to Example 1).

The results of the overvoltages for chlorine evolution and the corrosion rates are shown in Table 3.

The corrosion rates are higher than those measured in 4 M NaCl solution at pH 4 shown in Table 2. However, they are remarkably lower than the corrosion rates of the composite oxide electrodes. The high corrosion resistance and the low overvoltages for chlorine evolution clearly reveal that the amorphous alloys of the present invention have excellent characteristics as the anode for electrolysis of alkali halide solutions.

EXAMPLE 3

Electrolysis was carried out by using the amorphous alloys as anodes in the saturated KCl solution at 80° C.

For example, the corrosion rates of the specimens No. 35, 37, 46 and 61 are 2.50, 2.14, 3.45 and 2.90 μm/year, and hence they possess high corrosion resistance.

TABLE 1

Compositions of Amorphous Alloys of the Invention (atomic percent)

| Specimen No. | Pd | Rh | Pt | Ru | Ir | Ti | Zr | Nb | Ta | P | Si |
|---|---|---|---|---|---|---|---|---|---|---|---|
| 1 | 71 | 10 | | | | | | | | 19 | |
| 2 | 61 | 20 | | | | | | | | 19 | |
| 3 | 55 | 25 | | | | | | | | | 20 |
| 4 | 56 | 25 | | | | | | | | 19 | |
| 5 | 51 | 30 | | | | | | | | 19 | |
| 6 | | 10 | 70 | | | | | | | 20 | |
| 7 | | 20 | 60 | | | | | | | | 20 |
| 8 | | 20 | 60 | | | | | | | 20 | |
| 9 | | 30 | 50 | | | | | | | 11 | 9 |
| 10 | 61 | | 20 | | | | | | | 10 | 9 |
| 11 | 56 | | 25 | | | | | | | 10 | 9 |
| 12 | 42 | 25 | 10 | | | | | | | 23 | |
| 13 | 53 | 25 | | 2 | | | | | | | 20 |
| 14 | 51 | 25 | | 5 | | | | | | 19 | |
| 15 | 46 | | 25 | 10 | | | | | | 19 | |
| 16 | 36 | | 25 | 20 | | | | | | 19 | |
| 17 | | 30 | 41 | 10 | | | | | | 19 | |
| 18 | 54 | 25 | | | 2 | | | | | 19 | |
| 19 | 51 | 25 | | | 5 | | | | | 19 | |
| 20 | | 41 | 30 | | 10 | | | | | 19 | |
| 21 | 54 | 20 | | | | 2 | | | | | 24 |
| 22 | 56 | 20 | | | | 5 | | | | 19 | |
| 23 | 51 | 20 | | | | 10 | | | | 19 | |
| 24 | 49 | 20 | | | | 16 | | | | 15 | |
| 25 | 55 | 25 | | | | 1 | | | | 19 | |
| 26 | 54 | 25 | | | | 2 | | | | 19 | |
| 27 | 51 | 25 | | | | 5 | | | | 19 | |
| 28 | 46 | 25 | | | | 10 | | | | 19 | |
| 29 | 41 | 25 | | | | 15 | | | | 19 | |
| 30 | 46 | 30 | | | | 5 | | | | 19 | |
| 31 | 30 | | 46 | | | 5 | | | | 19 | |
| 32 | 46 | 30 | | | | | 5 | | | 19 | |
| 33 | | 51 | 25 | | | | | 5 | | 19 | |
| 34 | | 25 | 51 | | | | | | 5 | 19 | |
| 35 | 46 | 25 | 5 | | | 5 | | | | 19 | |
| 36 | 46 | 25 | | 5 | | 5 | | | | 19 | |
| 37 | 46 | 25 | | | 5 | 5 | | | | 19 | |
| 38 | 46 | 25 | | | | 5 | 5 | | | 19 | |
| 39 | 45 | 25 | | | | 5 | | 5 | | 10 | 10 |
| 40 | 46 | 25 | | | | 5 | | | 5 | 19 | |

TABLE 1-continued

| Specimen No. | Pd | Rh | Pt | Ru | Ir | Ti | Zr | Nb | Ta | P | Si |
|---|---|---|---|---|---|---|---|---|---|---|---|
| | Compositions of Amorphous Alloys of the Invention (atomic percent) | | | | | | | | | | |
| 41 | | | 56 | 10 | 5 | | 5 | | 5 | 19 | |
| 42 | 51 | | | 5 | 15 | | | | 10 | 19 | |
| 43 | | 51 | | 10 | 10 | | 5 | 5 | | 19 | |
| 44 | 31 | 10 | | 40 | | | | | | 19 | |
| 45 | 25 | 5 | | 50 | | | | | | 20 | |
| 46 | 41 | | | | 40 | | | | | 19 | |
| 47 | 31 | | | | 50 | | | | | 19 | |
| 48 | 46 | 5 | | | 30 | | | | | 19 | |
| 49 | 46 | | 5 | | 30 | | | | | 19 | |
| 50 | 41 | 10 | | | 30 | | | | | 19 | |
| 51 | 30 | 20 | | | 30 | | | | | 20 | |
| 52 | 41 | | 10 | | 30 | | | | | 19 | |
| 53 | 36 | 10 | | 10 | 25 | | | | | 19 | |
| 54 | 20 | | 20 | 20 | 20 | | | | | | 20 |
| 55 | 15 | | | 30 | 35 | | | | | | 20 |
| 56 | 39 | | | 10 | 30 | | | | | 21 | |
| 57 | 21 | | | 10 | 50 | | | | | | 19 |
| 58 | | | 46 | 34 | | | | | | | 20 |
| 59 | | | 10 | 10 | 60 | | | | | 20 | |
| 60 | 41 | | | | 35 | 5 | | | | 19 | |
| 61 | 47 | | | | 30 | 5 | | | | 18 | |
| 62 | 41 | | | | 30 | 10 | | | | 19 | |
| 63 | 41 | | | | 25 | 15 | | | | 19 | |
| 64 | 36 | | | 40 | | 5 | | | | 19 | |
| 65 | 41 | | | 30 | | 10 | | | | 19 | |
| 66 | 44 | 5 | | | 28 | 5 | | | | 18 | |
| 67 | 45 | 10 | | | 25 | 2 | | | | 18 | |
| 68 | 39 | 10 | | | 20 | 15 | | | | 16 | |
| 69 | | 10 | 10 | 20 | 35 | 5 | | | | | 20 |
| 70 | 15 | | | 30 | 30 | 5 | | | | 20 | |
| 71 | 41 | | | | 35 | | 5 | | | 10 | 9 |
| 72 | 41 | | | | 35 | | | 5 | | 10 | 9 |
| 73 | 41 | | | | 35 | | | | 5 | 10 | 9 |
| 74 | 40 | | | | 30 | | | | 10 | 10 | 10 |
| 75 | 30 | | 10 | | 25 | 5 | | 15 | | 15 | |
| 76 | 25 | | 10 | | 25 | 10 | | 12 | | 18 | |

TABLE 2

Corrosion Rates and Overvoltages for Chlorine Evolution of Amorphous Alloys of the Present Invention Measured by Galvanostatic Polarization at 50 A/dm$^2$ in 4 M NaCl Solution at pH 4 and 80° C.

| Specimen No. | Corrosion rates (μm/year) | Overvoltage for chlorine evolution V(SCE) |
|---|---|---|
| 4 | 18.50 | 1.11 |
| 5 | 4.87 | 1.11 |
| 19 | 15.31 | 1.10 |
| 26 | 11.36 | 1.09 |
| 27 | 5.19 | 1.10 |
| 28 | 4.22 | 1.14 |
| 29 | 2.01 | 1.17 |
| 30 | 1.23 | 1.10 |
| 35 | 0.00 | 1.12 |
| 36 | 2.17 | 1.09 |
| 37 | 0.00 | 1.10 |
| 38 | 1.91 | 1.14 |
| 39 | 2.21 | 1.12 |
| 40 | 1.91 | 1.12 |
| 41 | 1.01 | 1.11 |
| 42 | 2.03 | 1.11 |
| 43 | 1.07 | 1.10 |
| 44 | 7.01 | 1.09 |
| 45 | 10.24 | 1.12 |
| 46 | 1.45 | 1.08 |
| 47 | 0.81 | 1.11 |
| 48 | 5.27 | 1.09 |
| 49 | 3.02 | 1.11 |
| 50 | 0.25 | 1.09 |
| 51 | 0.34 | 1.11 |
| 52 | 0.57 | 1.13 |
| 53 | 0.12 | 1.09 |
| 54 | 0.57 | 1.13 |
| 54 | 0.03 | 1.14 |
| 55 | 11.45 | 1.15 |

TABLE 2-continued

Corrosion Rates and Overvoltages for Chlorine Evolution of Amorphous Alloys of the Present Invention Measured by Galvanostatic Polarization at 50 A/dm$^2$ in 4 M NaCl Solution at pH 4 and 80° C.

| Specimen No. | Corrosion rates (μm/year) | Overvoltage for chlorine evolution V(SCE) |
|---|---|---|
| 56 | 5.68 | 1.12 |
| 57 | 2.45 | 1.16 |
| 58 | 0.00 | 1.19 |
| 59 | 0.04 | 1.17 |
| 60 | 0.06 | 1.09 |
| 61 | 0.29 | 1.08 |
| 62 | 0.02 | 1.09 |
| 63 | 0.00 | 1.12 |
| 64 | 5.46 | 1.14 |
| 65 | 1.75 | 1.12 |
| 66 | 0.03 | 1.09 |
| 67 | 0.01 | 1.08 |
| 68 | 6.00 | 1.12 |
| 69 | 0.00 | 1.14 |
| 70 | 1.27 | 1.15 |
| 71 | 1.18 | 1.09 |
| 72 | 1.03 | 1.10 |
| 73 | 2.11 | 1.13 |
| 74 | 15.29 | 1.11 |
| 75 | 0.04 | 1.13 |
| 76 | 0.00 | 1.15 |

TABLE 3

Corrosion Rates and Overvoltages for Chlorine Evolution of Amorphous Alloys for the Present Invention Measured by Galvanostatic Polarization at 50 A/dm$^2$ in 4 M NaCl Solution at pH 2 and 80° C.

| Specimen No. | Corrosion rates (μm/year) | Overvoltage for chlorine evolution V(SCE) |
|---|---|---|
| 30 | 16.23 | 1.10 |
| 35 | 11.68 | 1.11 |
| 36 | 39.02 | 1.09 |
| 37 | 71.39 | 1.10 |
| 46 | 7.85 | 1.08 |
| 48 | 32.49 | 1.09 |
| 60 | 17.65 | 1.09 |
| 61 | 45.27 | 1.08 |
| 62 | 3.21 | 1.09 |
| 67 | 8.45 | 1.08 |

We claim:

1. An amorphous alloy which is prepared by rapid quenching at a cooling rate of higher than 10,000° C./sec. from the liquid state and consists of
   (1) 10 to 40 atomic percent of P and/or Si
   (2) 90 to 60 atomic percent of two or more of Pd, Rh and Pt.

2. An amorphous alloy which is prepared by rapid quenching from the liquid state and consists of
   (1) 10 to 40 atomic percent of P and/or Si and
   (2) 90 to 60 atomic percent of Pd, Rh and Pt and 1 to 25 atomic percent Ti, Zr, Nb and/or Ta.

3. An amorphous alloy which is prepared by rapid quenching from the liquid state and consists of
   (1) 10 to 40 atomic percent P and/or Si and
   (2) 90 to 60 atomic percent Pd, Rh and/or Pt and 2 to 80 atomic percent Ir and/or Ru.

4. An amorphous alloy which is prepared by rapid quenching from the liquid state and consists of
   (1) 10 to 40 atomic percent P and/or Si and
   (2) 90 to 60 atomic percent Pd, Rh and/or Pt, 2 to 80 atomic percent Ir and/or Ru and 1 to 25 atomic percent Ti, Zr, Nb and/or Ta.

5. An amorphous alloy electrode for electrolysis which consists of (1) 10 to 40 atomic percent of P and/or Si (2) 90 to 60 atomic percent of two or more of Pd, Rh and Pt.

6. An amorphous alloy electrode for electrolysis which consists of (1) 10 to 40 atomic percent of P and/or Si and (2) 90 to 60 atomic percent of Pd, Rh and Pt and 1 to 25 atomic percent Ti, Zr, Nb and/or Ta.

7. An amorphous alloy electrode for electrolysis which consists of (1) 10 to 40 atomic percent P and/or Si and (2) 90 to 60 atomic percent Pd, Rh and/or Pt and 2 to 80 atomic percent Ir and/or Ru.

8. An amorphous alloy electrode for electrolysis which consists of (1) 10 to 40 atomic percent P and/or Si and (2) 90 to 60 atomic percent Pd, Rh and/or Pt, 2 to 80 atomic percent Ir and/or Ru and 1 to 25 atomic percent Ti, Zr, Nb and/or Ta.

* * * * *